United States Patent [19]

Schill

[11] 4,087,006

[45] May 2, 1978

[54] MOUNTABLE AND DISMOUNTABLE CLOTHES HANGER BAR

[76] Inventor: John Michael Schill, 208 Samuel Street, Kitchener, Ontario, Canada

[21] Appl. No.: 749,685

[22] Filed: Dec. 13, 1976

[51] Int. Cl.[2] ..... A47F 5/01

[52] U.S. Cl. ..... 211/86; 211/105.6; 248/214

[58] Field of Search ..... 211/86, 123, 105.1–105.6, 211/182; 248/214, 215, 339, 340, 353, 251

[56] References Cited

U.S. PATENT DOCUMENTS

| | | | |
|---|---|---|---|
| 2,144,772 | 1/1939 | Plants | 211/182 X |
| 3,019,909 | 2/1962 | Churchill | 211/86 |
| 3,076,556 | 2/1963 | White | 248/215 X |
| 3,163,295 | 12/1964 | Standard | 211/86 |
| 3,350,120 | 10/1967 | Hinrichs | 211/105.6 X |

*Primary Examiner*—Roy D. Frazier
*Assistant Examiner*—Terrell P. Lewis
*Attorney, Agent, or Firm*—Hirons & Rogers

[57] ABSTRACT

A clothes hanger bar is readily mountable and dismountable between a wall and a horizontal member, such as shower curtain rod or upper edge of a shower stall door. The hanger bar consists of a clothes-supporting portion for disposition horizontally having a bracket at one end that engages the horizontal member and also prevents sideways rotation. The other end of the rod is of Z shape with the clothes-supporting portion as an extended lower leg while the upper leg carries a wall-engaging member. The point of contact with the wall is above the point of intersection of the axis of the clothes supporting portion with the wall, so that the clothes-supporting portion is mounted in suspension and the weight of the clothes forces the wall-engaging member into firmer contact with the wall. The wall-engaging member may comprise a sleeve that can accommodate extension members of different lengths to adjust the effective length of the hanger bar.

4 Claims, 3 Drawing Figures

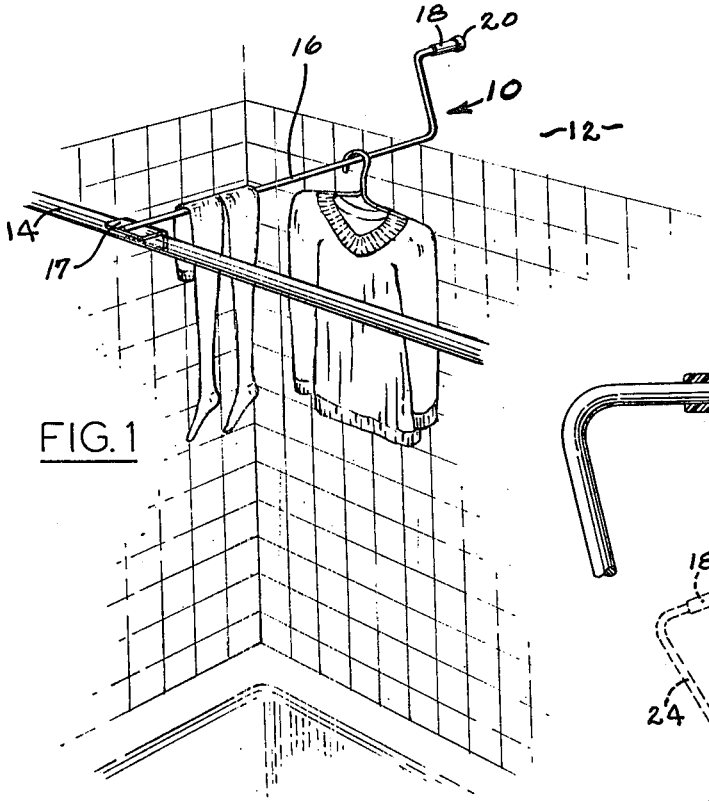
FIG. 1
FIG. 3
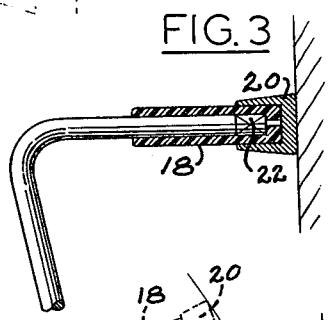
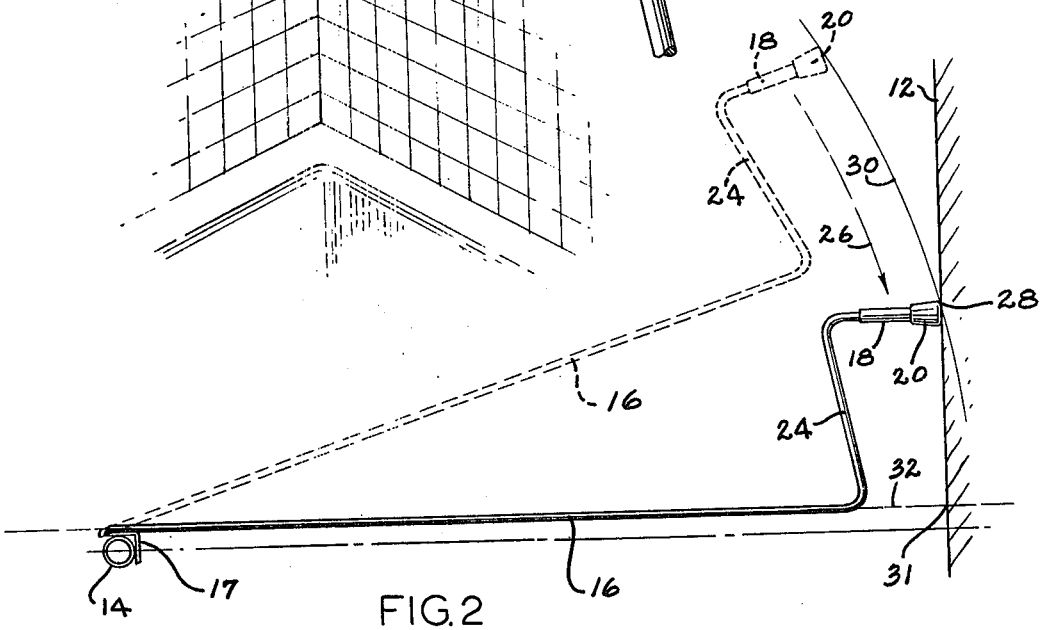
FIG. 2

MOUNTABLE AND DISMOUNTABLE CLOTHES HANGER BAR

FIELD OF THE INVENTION

The present invention is concerned with improvements in or relating to clothes hanger bars, that is to say bars of the type on which clothes may be hung at some convenient location for drying or airing purposes, and especially to such bars which are readily mountable in, and dismountable from, the selected location.

REVIEW OF THE PRIOR ART

Numerous attempts have been made hitherto to provide some facility for hanging clothes for drying or airing in a chosen location, such as in a shower stall or over a bath tub. One type of such device requires at least one part to be permanently fixed to the wall, so as to provide a sufficiently stable mounting, and thus has many obvious disadvantages. Another type has a spring which is operative to retain the device in position and, although this does not require permanent fixing, the spring must be relatively strong if the mounting is to be secure, making them difficult to mount and dismount.

DEFINITION OF THE INVENTION

It is therefore an object of the invention to provide a new readily mountable and dismountable clothes hanger bar.

It is a more specific object to provide such a bar that is securely mountable between a wall and a horizontal member, such as a rod or upper door edge spaced from the wall, without the need for a permanently-fixed part or a spring.

It is another object to provide such a bar that is easily adjustable to accomodate differences in distance between the wall and the horizontal member without the use of springs, sliding sections, or screw-threaded members.

It is a further object to provide such a bar that will position itself automatically between the wall and the horizontal member upon being mounted.

In accordance with the present invention there is provided a mountable and dismountable clothes hanger bar mountable between a wall and a horizontal member spaced from the wall, the bar comprising:

an elongated bar member of Z-shape with upper and lower legs and a connection part connecting the legs, the lower one of the legs providing a substantially horizontal clothes-supporting portion having a longitudinal axis from which portion clothes can be hung;

a bracket member fastened at or adjacent to the free end of the said bar lower leg and engagable with the horizontal member to be supported thereby so as to prevent longitudinal movement of the bar lower leg;

the said connection part extending upwards and being angled to incline away from the wall in its extension upward, the bar member upper leg providing at its free end a wall-engaging member engagable with the wall at a point higher than the point of intersection of the said longitudinal axis of the lower leg with the walls;

whereby the said clothes-supporting portion is mounted in suspension between the bracket member and the wall-engaging member.

DESCRIPTION OF THE DRAWING

A clothes hanger bar which is a particular preferred embodiment of the invention will not be described, by way of example, with reference to the accompanying diagrammatic drawing wherein:

FIG. 1 is a perspective view showing the hanger bar in mounted position over a bath tub between a wall of the bath tub enclosure and the shower curtain rod, FIG. 2 is a side elevation to a larger scale to show more clearly the manner in which the rod is mounted and dismounted, and FIG. 3 is a longitudinal section through the end of the bar which engages the wall.

DESCRIPTION OF THE PREFERRED EMBODIMENT

The clothes hanger bar 10 is illustrated as mounted between a wall 12 of a bath enclosure and a horizontal member constituted by a shower curtain rod 14 spaced from and parallel to the wall. The horizontal member could however be constituted by some other structure providing a suitable horizontal surface spaced from the wall, such as the upper edge of a shower stall door. The bar comprises an elongated bar member, preferably of plastic-coated metal, providing between its ends a clothes-supporting portion 16. One end of the bar member has an L-shape bracket member 17 fastened thereto, the member being engaged with the rod 14 (or the upper edge of the shower stall door) so that one leg of the L is horizontal and the other leg is vertical, the bar member being fastened to the horizontal leg. The bracket member is thus operative to prevent longitudinal movement of the hanger rod, and also extends a substantial distance lengthwise of the rod 14, so that the hanger bar is held firmly against sideways rotation about its longitudinal axis.

The other end of the bar member is of Z-shape with the clothes-supporting portion as the highly extended lower leg thereof, while the end of the other upper leg of the Z carries a wall-engaging member constituted by a removable sleeve 18, having a tip 20 at its free end. Referring to FIG. 3, extension members 22 of different lengths can be inserted in the sleeve 18 before it is placed on the rod member end, so as to vary the effective length of this leg of the Z and thereby adjust the length of the bar to suit the distance between the wall 12 and rod 14. The connecting part 24 of the Z is angled to incline away from the wall in its extension upward, so that the portion 16 is as long as possible and an improved springing effect is obtained as the bar is installed.

In operation the bar is installed without the need for any permanently-fixed part by engaging the bracket member 17 with the rod 14 with the bar pointing upward, as shown in broken lines in FIG. 2. The bar is then rotated downward about the rod 14 as a pivot in the direction of the arrow 26, until the tip 20 engages the wall 12 at a point 28 where its path of movement 30 intersects the wall. If the point 28 is too high, so that the bar portion 16 is not sufficiently horizontal, a shorter extension member 22 is employed, or is omitted altogether. If the point is too low a longer extension member is used. The point 28 is a substantial distance above a point 31 where the longitudinal axis 32 of the clothes-supporting portion 16 intersects the wall, so that the portion 16 is mounted in suspension between the bracket member and the wall-engaging member.

It will be seen that with the sideways stabilizing action of the bracket 17, and with the length of the bar adjusted correctly, the bar positions itself automatically between the wall and the rod, and that once the bar has been installed it will remain firmly in position, the effect of loading it with clothes being only to force the bar lower and increase its engagement with the wall. The bar is dismounted simply by rotating it upwards until the tip 20 is disengaged from the wall. Other specific configurations of bracket 17 and the bar member other end can of course be employed within the scope of the appended claims.

I claim:

1. A mountable and dismountable clothes hanger bar mountable between a wall and a horizontal member spaced from the wall, the bar comprising:

an elongated bar member of Z-shape with upper and lower legs and a connection part connecting the legs, the lower one of the legs providing a substantially horizontal clothes-supporting portion having a longitudinal axis from which portion clothes can be hung;

a bracket member fastened at or adjacent to the free end of the said bar lower leg and engagable with the horizontal member to be supported thereby so as to prevent longitudinal movement of the bar lower leg;

the said connection part extending upwards and being angled to incline away from the wall in its extension upward, the bar member upper leg providing at its free end a wall-engaging member engagable with the wall at a point higher than the point of intersection of the said longitudinal axis of the lower leg with the wall;

whereby the said clothes-supporting portion is mounted in suspension between the bracket member and the wall-engaging member.

2. A hanger bar as claimed in claim 1, wherein the bracket member extends lengthwise of the horizontal member so as to be restrained by its engagement therewith against rotation of the clothes-supporting portion about the said longitudinal axis.

3. A hanger bar as claimed in claim 2, wherein the bracket member is of L-shape cross-section and is mountable on the horizontal member with one leg horizontal and one leg vertical, the bar member being fastened to the leg thereof that is horizontal with the bar in position.

4. A hanger bar as claimed in claim 1, wherein the wall-engaging member comprises a sleeve removable from the end of the bar hanger and able to accomodate therein extension members which when inserted therein increase the effective length of the wall engaging member.

* * * * *